United States Patent [19]

Tix

[11] Patent Number: 4,821,472

[45] Date of Patent: Apr. 18, 1989

[54] HINGED NAILING FIN FOR WINDOW INSTALLATION

[75] Inventor: James P. Tix, Hastings, Minn.

[73] Assignee: Plastic Profiles, Inc., Cannon Falls, Minn.

[21] Appl. No.: 138,057

[22] Filed: Dec. 28, 1987

[51] Int. Cl.[4] ..... E06B 1/04

[52] U.S. Cl. ..... 52/213; 52/214; 52/586

[58] Field of Search ..... 52/213, 214, 586, 216, 52/714, 712, 309.1; 16/DIG. 13

[56] References Cited

U.S. PATENT DOCUMENTS

| | | | |
|---|---|---|---|
| 3,019,486 | 2/1962 | Stinson | 16/DIG. 13 X |
| 3,325,585 | 6/1967 | Brenneman | 52/586 X |
| 3,416,275 | 12/1968 | Loghem et al. | 52/586 X |
| 3,623,288 | 11/1971 | Horowitz | 52/586 X |
| 3,996,706 | 12/1976 | Bomgaars | 52/586 X |
| 4,131,971 | 1/1979 | Saarloos | 16/DIG. 13 X |
| 4,413,456 | 11/1983 | Gilb | 52/714 X |
| 4,670,938 | 6/1987 | Fowlston | 16/DIG. 13 X |

*Primary Examiner*—Carl D. Friedman

*Attorney, Agent, or Firm*—Jacobson and Johnson

[57] ABSTRACT

An integrally formed plastic strip for use as a nailing fin for installing a window assembly in a building has a first stiff plastic member with nail holes through which the strip is attached to the supporting structure, a second narrower stiff plastic member for insertion into a kerf running along the outside of the window assembly for attaching the nailng fin to the window assembly, and a further narrow section of flexible plastic which hingedly connects together the stiff plastic sections so that the nailing fin can be attached to the window assembly and folded back to reduce space requirement during shipment of the window assembly.

18 Claims, 2 Drawing Sheets

HINGED NAILING FIN FOR WINDOW INSTALLATION

FIELD OF THE INVENTION

This invention is for use in the construction industry, more particularly in construction of buildings in which window assemblies are mounted for attachment to the supporting structure and, still more particularly, the invention is directed toward improvement in the nailing fins by which a window assembly is attached to the surrounding supporting structure.

DESCRIPTION OF THE PRIOR ART

Nailing fins for attaching window assemblies to the surrounding supporting structure have been known and utilized for some time in the construction industry and particularly in the home building industry. Typically and conventionally the fins are bands or strips of stiff material, for example stiff plastic or metal, which are attached along one elongated edge to the periphery of the frame of the window assembly and have nailing holes through which the nailing fin is attached to the surrounding supporting structure to hold the window assembly in place. In the past, factory made window assemblies were shipped with the nailing fins attached. Despite the fact that the nailing fin is relatively small compared to the window assembly, it took up a significant amount of space in a shipping container and therefore added to the expense and cost. As a result, manufacturers started shipping the fins separate from the window assembly, either tucked in spaces within the window assembly container or by a separate package. This would require additional bookwork and oftentimes the fins would be lost or damaged when shipped in this fashion or they would be overlooked and the assemblies would come without the nailing fins.

SUMMARY

The nailing fin of the instant invention is an integrally formed plastic strip having a relatively wide, stiff, thin plastic member containing nailing holes through which the strip is attached to the supporting surrounding structure, a relatively narrow stiff thin plastic strip running alongside the first mentioned strip and having means for attaching it to the outer peripheral edge of the window assembly, and a third, still narrower strip or band of resilient plastic joining together the two parallel elongated edges of the first two mentioned strips. The latter provides a hinge connection between the stiff plastic sections so that when the nailing fin is attached to the window assembly for shipping, the portion which contains the nail holes can be folded back out of the way so it does not take any room in the shipping container and when the asembly is removed from the shipping container, the nailing fin will spring into place ready for installation. In this fashion, then, the problem of added cost of shipping is eliminated yet the nailing fin is attached to the window frame assembly so it is not likely to be lost or damaged in shipment. Further, under present day techniques, the nailing fin can be made as an integrally extruded plastic strip with the two relatively stiff members attached together by the relatively flexible member.

As a further feature, the nailing fin is provided with an integrally formed plastic wing or flange which extends out from the nailing section over the hinge section. As still another feature, the nailing fin may be attached to the window assembly by virtue of one edge nestling in an elongated kerf in the frame of the window assembly with integrally formed flexible plastic barbs holding it securely to the window assembly. This avoids the need for nailing, stapling, or using adhesive to attach the nailing fin to the window frame.

DESCRIPTION OF THE PREFERRED EMBODIMENT(S)

Figure 1:
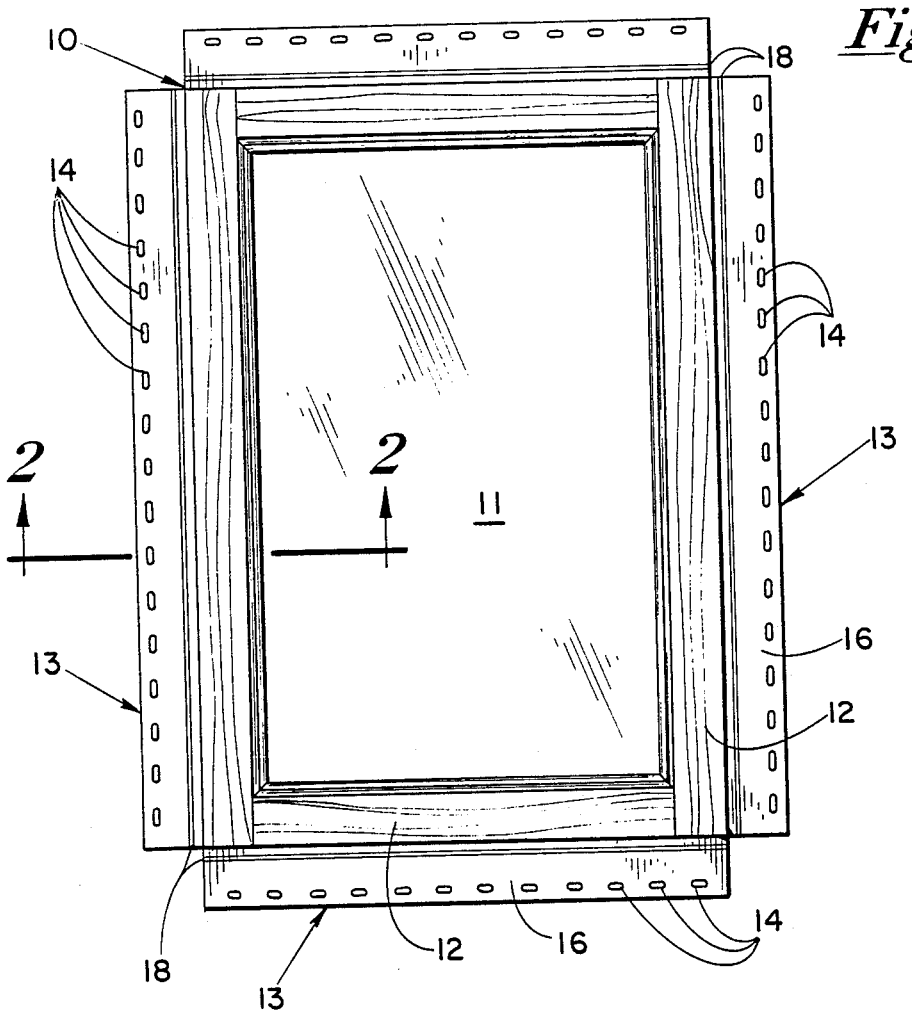
FIG. 1 is a plan view of a window assembly with attached nailing fin.

In general, a window assembly, generally designated by reference numeral 10, is made up of a pane (or double pane) of glass or glazing 11 enclosed within a frame 12, typically made of wood, which may or may not be clad with an outer protective layer of plastic or metal. Details of the construction of the window assembly are not essential to an understanding of the instant invention and so are not included herein. Typically and conventionally for installation nailing fins 13 are attached to the periphery or outer edge of the window frame 12. The window assembly normally is inserted in an opening in the wall of the building being constructed, such as a house, and the nailing fins 13 rest against the supporting surrounding structure. Nails, not shown, are driven into the structure through the nail holes 14 in the nailing fins to securely hold the window assembly in place. FIG. 1 illustrates quite dramatically the additional space required if the window assembly is shipped from the point of manufacture with the nailing fins attached. The shipping container must be large enough to accommodate the nailing fins and must provide some protection against the nailing fins being damaged.

Figure 2:
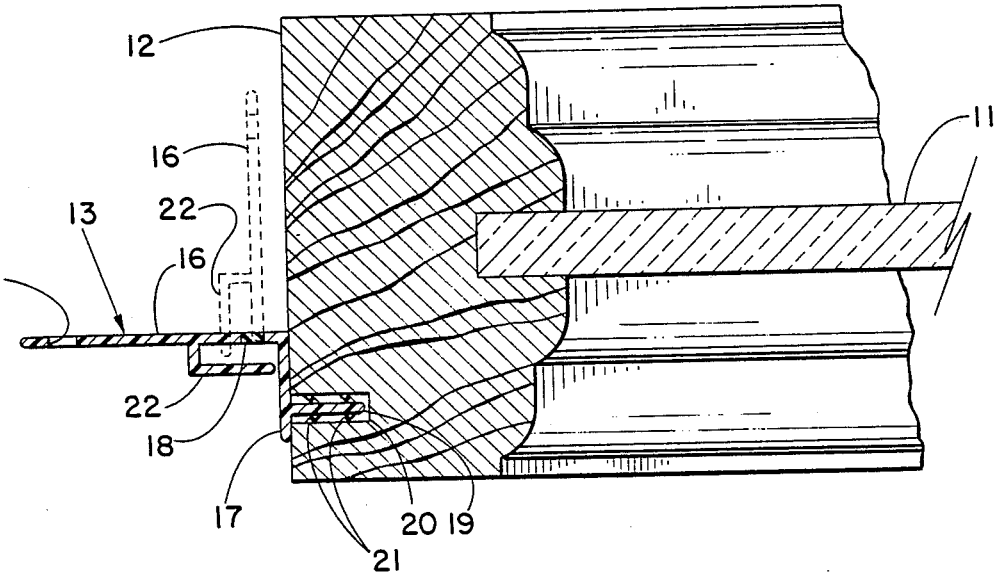
FIG. 2 is a section view taken along viewing line 2—2 of FIG. 1 illustrating a preferred embodiment of the invention.
Figure 3:
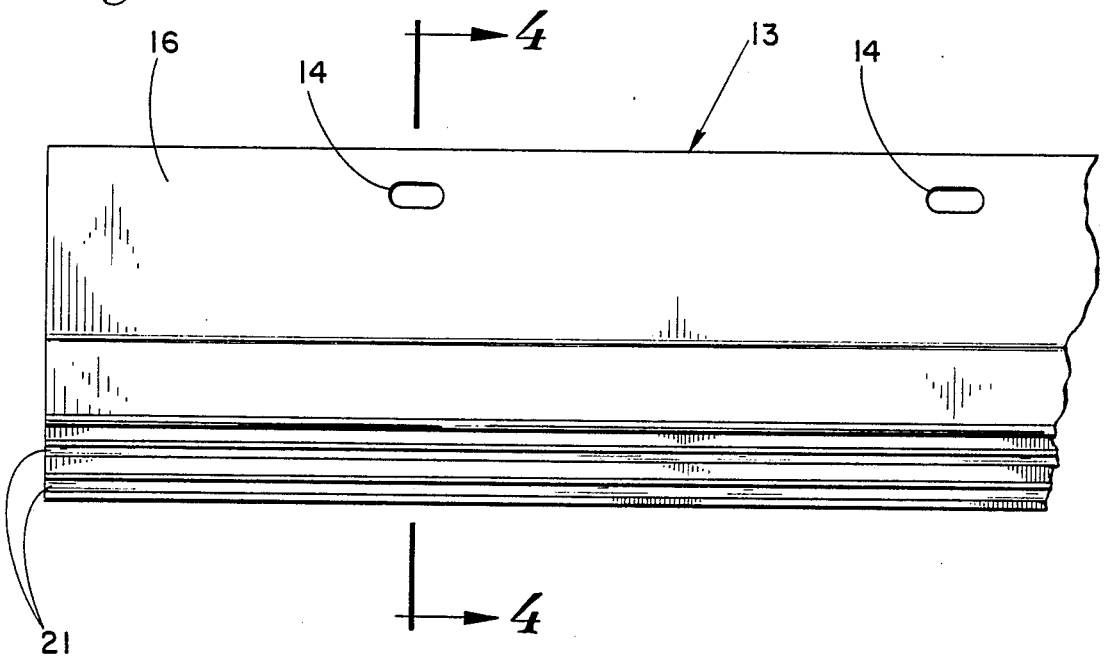
FIG. 3 is a plan view of a preferred embodiment of the invention.
Figure 4:
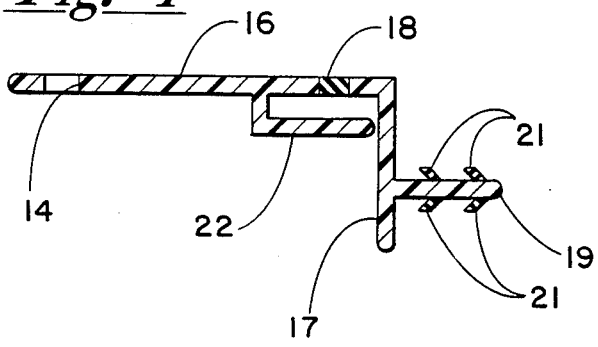
FIG. 4 is a section view taken along viewing line 4—4 of FIG. 3.

The nailing fin 13 which is a preferred embodiment of this invention is seen in some detail in FIG. 2 as it appears when attached to the window frame assembly 10 as described above. The nailing fins 13 extend laterally out from the frame 12 and securing nails (not shown) are inserted through the nail holes 14 into the surrounding supporting frame structure, not shown. Referring to FIGS. 2, 3 and 4, the nailing fin of the instant invention has a first elongated thin relatively wide strip or section 16 made of a suitably stiff plastic such as vinyl with nailing holes 14 formed therein. A second elongated narrower thin band or strip 17 of stiff material, for example vinyl plastic, extends parallel to member 16 along one edge and members 16 and 17 are attached together along their adjacent edges by a very narrow strip or band 18 of flexible material which typically may be polyurethane. In the preferred embodiment which is described and illustrated, member 17 is L-shaped with its distal edge or leg 19 inserted in an elongated slot or kerf 20 in the outer frame 12 of the window assembly. Extending out along each side of leg 19 are flexible or resilient barb-shaped lengths 21 of suitable resilient plastic which grip the interior walls of the kerf 20 to securely hold leg 19, and thereby the entire nailing fin, attached to the window assembly. This is one manner of attaching the nailing fin. It could be attached with a suitable adhesive or nailed or stapled to the outer edge or periphery of the window frame. In any event, the entire nailing fin 13 is one integrally formed piece. All of the sections and component parts, namely the nailing section or member 16, the window frame attaching section or member 17, the hinge section or member 18, and the barbs 21, are co-extruded with the nailing section 16 and the window frame attaching section 17 being joined by the hinge section 18 during the extrusion process.

As illustrated by dashed line in FIG. 2, the nailing section 16 of the nailing fin can be folded up along the hinge line defined by element or member 18 so that it rests alongside the frame 12 of the window assembly so that it takes up little or no additional space when the window assembly with attached nailing fin is placed in a shipping container. In a typical case in the past, window assemblies having factory installed nailing fins would require packages or containers which were more than 3" higher and 3" wider than the window unit itself, merely to allow for the nailing fin. Not only that, but the additional area in the container required reinforcement so that the window assembly could be shipped in an upright position without crushing the nailing fin. Both of these added to the cost of the window assembly. Alternatively, the nailing fin was shipped separately but this would require additional paperwork, separate inventory, separate packaging, and could result in the window assembly being received and yet the nailing fins lost or still in transit. Sometimes the nailing fins were loosely slipped into the container for the window assembly unit but oftentimes they would get damaged or lost when shipped in this fashion.

As an added feature, a wing or flange 22 may be formed integrally with the nailing section 16 of the nailing fin to extend out over the hinge section 18. This provides a protection for the hinge section when the nailing fin is in place for nailing and also ensures that the nailing section 16 stays lateral with the window assembly and doesn't swing too far forward when released from the folded position (dashed line FIG. 2). Flange 22 also provides means for applying the force to push attaching member 17 into the kerf in the window frame. As viewed in FIG. 2, pushing on the far edge of nailing section 16 brings the edge of flange 22 up against member 17 to force leg 19 into kerf 20.

I claim:

1. For use with a window assembly having a window glazing enclosed by a surrounding frame, a foldable nailing fin, comprising:

a first flat elongated thin strip of generally stiff material containing nail holes for attaching said first strip to a support structure;

a second elongated strip of generally stiff material with an elongated edge parallel to and adjoining an elongated edge of said first strip;

means for attaching said second strip lengthwise to a side of the frame of a window assembly; and flexible means hingedly attaching said strips along said adjoining edges for releasably folding said strips.

2. The foldable nailing fin as described in claim 1 wherein said hingedly attaching means comprises a strip of resilient material integrally formed with said first and second strips along their adjoining edges.

3. The foldable nailing fin as described in claim 2 wherein said means for attaching the second strip to the window frame comprises:

an elongated kerf in a side of the window frame; and means adjacent the distal elongated edge of said second strip for frictionally engaging said kerf.

4. The foldable nailing fin as described in claim 3 wherein said kerf engaging means comprises hooklike resilient material integrally formed with said second strip adjacent its distal elongated edge for frictionally gripping a sidewall of said kerf when the distal elongated edge of said second strip is inserted in said kerf.

5. The foldable nailing fin as described in claim 4 further including a flange member extending from said first strip over said hingedly attaching means toward said second strip for forcing said second strip into said kerf.

6. A foldable nailing fin as described in claim 2 wherein:

said first and second strips are of the same material and said resilient strip is of a different material.

7. A foldable nailing fin as described in claim 6 wherein said first strip, said second strip and said resilient strip are of substantially equal thickness.

8. A foldable nailing fin as described in claim 7 wherein said strips are coextruded.

9. Asa a foldable nailing fin for a window assembly having a window glazing enclosed by a surrounding frame, an elongated integrally extruded strip of plastic comprising:

(a) a relatively wide thin elongated stiff plastic member containing nail holes for attaching the strip to a support structure;

(b) a relatively narrow thin elongated stiff plastic member having an elongated edge parallel and closely adjacent to an elongated edge of said first-mentioned member;

(c) a still narrower thin flexible plastic member hingedly connecting together said first and second mentioned members along their parallel adjacent edges for releasably folding together said first and second mentioned members; and (d) means for attaching said second mentioned member to a side of a window assembly.

10. The foldable nailing fin as described in claim 9 wherein said means for attaching said second-mentioned member to a side of a framed window assembly comprises:

an elongated kerf in a side of the window frame; and barb-like flexible plastic strips integrally formed with said second-mentioned member for frictionally grasping the sidewall of said kerf.

11. The foldable nailing fin as described in claim 10 further including a flange member extending from said wide member over said connecting member toward said narrow member for applying force against said narrow member to drive said flexible barb-like strips into said kerf.

12. The invention as described in claim 9 wherein said relatively wide and said relatively narrow members are of the same material and said still narrower member is of a different material.

13. The invention as described in claim 12 wherein said members are of substantially equal thickness.

14. The invention as described in claim 12 wherein said members are coextruded.

15. In combination:

a window assembly comprising a window glazing enclosed around its edges by a surrounding window frame;

a foldable nailing fin comprising a first flat elongated thin strip of generally stiff material containing nail holes for attaching said first strip to a support structure, a second elongated strip of generally stiff material with an elongated edge parallel to and adjoining an elongated edge of said first strip, and a third resilient strip hingedly attaching together said first and second strips along their adjoining edges; and means for attaching said second strip lengthwise to a side of the frame of said window assembly.

16. The combination as described in claim 15 wherein said means for attaching said second strip to said window assembly, comprises:

an elongated kerf in a side of the window frame assembly; and means adjacent the distal elongated edge of said second strip for frictionally engaging said kerf.

17. The combination as described in claim 16 wherein said kerf engaging means comprises hooklike resilient material integrally formed with said second strip adjacent its distal elongated edge for frictionally gripping a side wall of said kerf when the distal elongated edge of said second strip is inserted in said kerf.

18. The combination as described in claim 17 further including a flange member extending from said first strip over said hingedly attaching strip toward said second strip for forcing said second strip into said kerf.

* * * * *